United States Patent [19]

Feldman

[11] Patent Number: 4,787,916

[45] Date of Patent: Nov. 29, 1988

[54] METHOD AND FUEL COMPOSITION FOR REDUCING OCTANE REQUIREMENT INCREASE

[75] Inventor: Nicholas Feldman, Woodbridge, N.J.

[73] Assignee: Exxon Research and Engineering Company, Florham Park, N.J.

[21] Appl. No.: 925,168

[22] Filed: Oct. 31, 1986

[51] Int. Cl.[4] ..... C10L 1/22

[52] U.S. Cl. ..... 44/92; 44/66; 44/75

[58] Field of Search ..... 44/72, 75, 66

[56] References Cited

U.S. PATENT DOCUMENTS

| | | | |
|---|---|---|---|
| 3,008,813 | 11/1961 | Siegel | 44/72 |
| 3,033,665 | 5/1962 | Gaston | 44/72 |
| 3,317,291 | 5/1967 | Marsh et al. | 44/72 |
| 3,387,954 | 6/1968 | Capowski et al. | 44/72 |
| 3,403,014 | 9/1968 | Allmen et al. | 44/72 |
| 3,468,640 | 9/1969 | Barusch et al. | 44/75 |
| 3,652,644 | 3/1972 | Farari et al. | 260/471 R |
| 3,709,668 | 1/1973 | Zimmerman et al. | 44/72 |
| 3,778,371 | 12/1973 | Malec | 44/72 |
| 3,895,925 | 7/1975 | Sohlicht et al. | 44/72 |
| 4,357,148 | 11/1982 | Graiff | 44/62 |

FOREIGN PATENT DOCUMENTS 1085164 9/1980 Canada .

*Primary Examiner*—William R. Dixon, Jr.
*Assistant Examiner*—Margaret B. Medley
*Attorney, Agent, or Firm*—Joseph J. Dvorak; John W. Ditsler

[57] ABSTRACT

It has been found that when minor amounts of quaternary ammonium hydroxides are added to gasolines, the octane requirement increase for fuel fired spark ignition internal combustion engines is decreased or reversed.

Thus, in one aspect, the present invention comprises a method for controlling the ORI of spark ignition internal combustion engines by operating such engines on a fuel containing certain quaternary ammonium hydroxides in amounts sufficient to control the ORI.

13 Claims, 2 Drawing Sheets

METHOD AND FUEL COMPOSITION FOR REDUCING OCTANE REQUIREMENT INCREASE

FIELD OF THE INVENTION

The present invention relates to a method for improving the operation of a gasoline fueled spark ignition internal combustion engine. More specifically, the present invention relates to a method for controlling or decreasing the octane requirement increase typically encountered during the first several thousand miles of operation of gasoline fueled spark ignition internal combustion engines.

BACKGROUND OF THE INVENTION

As is known in the art, the octane requirement is lower for a new or cleaned spark fired internal combustion engine than for one that has been subjected to operation over a period of time equivalent to several thousand miles. In other words, as a new or clean engine is used or operated an octane requirement increase (ORI) is observed, i.e., the octane number of the fuel required for knock-free operation of the engine increases over time until a stable level is reached. Also known is the fact that the observed octane requirement increase is associated with build-up of deposits in the combustion chamber of the engine. Consequently, additives have been employed for preventing or reducing deposit formation in or for removing the deposits from the combustion chamber once they have been formed. In this regard, see, for example, U.S. Pat. No. 4,357,148 and the patents cited therein.

Obviously, there is always a need for new, better and more economical additives which will function so as to reduce the octane requirement increase of spark ignition internal combustion engines.

SUMMARY OF THE INVENTION

Surprisingly it has been found that when minor amounts of quaternary ammonium hydroxides are added to gasolines, the octane requirement increase for fuel fired spark ignition internal combustion engines is decreased or reversed.

The quaternary ammonium hydroxides useful according to the present invention are selected from compounds having a general structure:

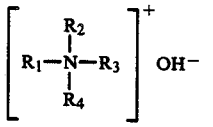

wherein $R_1$ is a hydrocarbon radical having from 1 to 24 carbon atoms and $R_2$, $R_3$ and $R_4$ are hydrocarbon radicals having from 4 to 24 carbon atoms provided that when $R_1$ has from 1 to 3 carbon atoms then at least $R_2$ and $R_3$ are the same and have from 7 to 24 carbon atoms.

The hydrocarbon radicals in the above quaternary ammonium hydroxides can be normal or branched alkyl groups, unsaturated paraffin groups, cyclic hydrocarbons and aralkyl groups.

Preferred compounds useful in the practice of the present invention include quaternary ammonium hydroxides of butyl, octyl, dodecyl, decyl, caprylic hydrocarbon radicals.

Thus, in one aspect, the present invention comprises a method for controlling the ORI of spark ignition internal combustion engines by operating such engines on a fuel containing a quaternary ammonium hydroxide of the aforementioned type in amounts sufficient to control the ORI.

In view of the foregoing, it should be appreciated that the additives of the present invention may be introduced directly into gasoline, i.e., a liquid hydrocarbon fuel in the gasoline boiling range in amounts sufficient to decrease the ORI thereby providing a composition comprising a major portion of a hydrocarbon base fuel boiling in the range of gasoline and including from about 0.001 to about 0.075 wt.% of a quaternary ammonium hydroxide of the above-mentioned formula. Indeed, it is particularly preferred to incorporate about 0.003 to about 0.030 wt.% quaternary ammonium hydroxide. Especially preferred is a gasoline composition comprising a major portion of a hydrocarbon based fuel boiling in the boiling range of gasoline and including from about 0.005 to about 0.015 wt.% of quaternary ammonium hydroxide selected from tetrabutylammonium hydroxide and tricaprylicmethyl ammonium hydroxide and mixtures thereof.

In another embodiment of the present invention a concentrate for use in a base fuel boiling in the range of gasoline is provided comprising about 20 to about 80 wt.% of the hereinabove described quaternary ammonium hydroxides in an appropriate organic solvent compatible with and boiling in the gasoline range. Suitable organic solvents include aromatic hydrocarbons such as benzene, toluene, xylene, alcohols such as ethanol, ethylisobutylcarbonyl and the like. Mixtures of hydrocarbons and alcohols may also be used in preparing the concentrate. In general the quantity of solvent in such concentrates will range from about 20 to about 80 wt.%. of the concentrate.

DESCRIPTION OF THE PREFERRED EMBODIMENTS

The following series of tests are presented to illustrate the invention.

EXAMPLE 1

Figure 1:
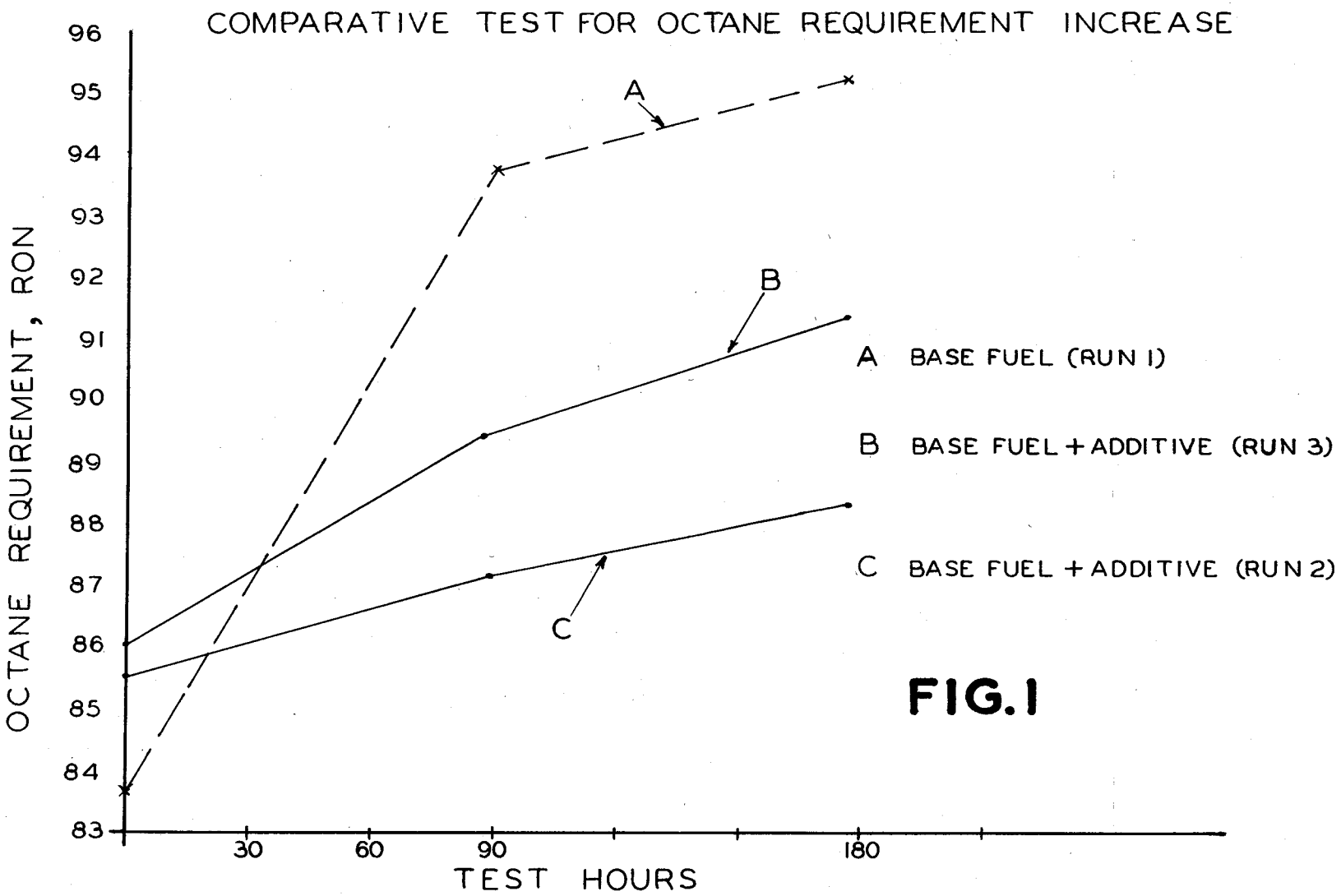
FIG. 1 is a graph illustrating the decrease in ORI over that of a base fuel achieved by practice of the present invention.

In this example, a 250 CID engine was employed which for each of the three tests conducted had first been cleaned by removing deposits from the intake manifolds, intake ports and combustion chamber area of the engine. As illustrated in Table I below, one of the tests was conducted with a base fuel while the remaining two tests were conducted with the same fuel but containing an additive of the present invention. The octane requirement of the engine was determined while increasing engine speed from 1500 to 3000 rpm in a 15 sec. period. The results are set forth in Table I below and shown graphically in FIG. 1.

TABLE I

| Test Fuel | Run 1 Base fuel | Run 2 Base fuel + additive(1) | Run 3 Base fuel + additive(1) |
|---|---|---|---|
| RON 0 hrs. | 84.9 | 85.5 | 85.9 |
| RON 180 hrs. | 95.2 | 88.3 | 91.3 |
| ORI | 10.3 | 2.8 | 5.4 |
| ORI Reduction | | 7.5 | 4.9 |

(1)Base fuel contained 0.006 wt. % tetrabutyl ammonium hydroxide.

EXAMPLE 2

The procedure of Example 1 was repeated with another 250 CID engine with the results shown in Table II below.

TABLE II

| Test Fuel | Run 1 Base fuel | Run 2 Base fuel + additive(1) | Run 3 Base fuel + additive(2) |
|---|---|---|---|
| RON at 0 hrs. | 84.7 | 83.9 | 83.7 |
| RON at 180 hrs. | 95.7 | 91.6 | 87.0 |
| ORI | 11.0 | 7.7 | 3.3 |
| ORI Reduction | | 3.3 | 7.7 |

(1)Base fuel contained 0.006 wt. % tetra butyl ammonium hydroxide.
(2)Base fuel contained 0.009 wt. % tricaprylic methyl ammonium hydroxide.

As can be seen from Examples 1 and 2, ORI reductions in the range of 3.3 to 7.7 octane numbers were obtained.

EXAMPLE 3

Figure 2:
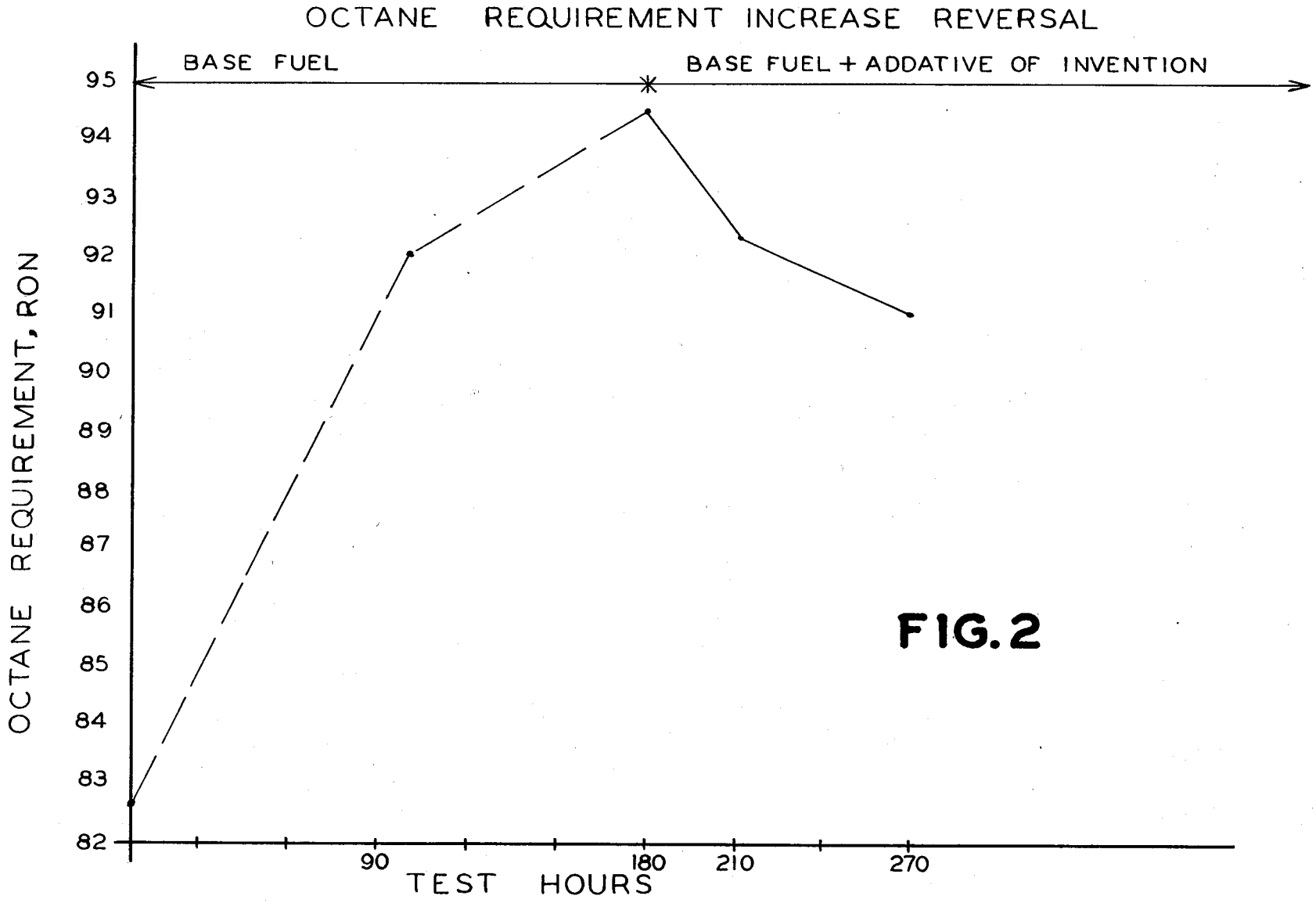
FIG. 2 is a graph showing the reversal of ORI that is achieved in accordance with the practice of the present invention.

In this example, the general procedure of Example 1 was followed. However, after running the engine for 180 hours on the base fuel, the engine was then operated without cleaning on a fuel containing an additive in accordance with this invention. Results are set forth in Table III below and depicted graphically in FIG. 2.

TABLE III

| Fuel | Base Fuel | | | Base Fuel + Additive(1) | |
|---|---|---|---|---|---|
| Test Hrs. | 0 | 90 | 180 | 210 | 276 |
| RON | 82.6 | 92.3 | 94.6 | 92.8 | 91.1 |

(1)Base fuel containing 0.009 wt. % tricaprylic methyl ammonium hydroxide.

As can be seen from the foregoing, the octane requirement of the engine, after having gone from 82.6 to 94.6 in 180 hours with the base fuel was reversed by use of an additive of this invention declining to 91.1 in 96 hours.

What is claimed is:

1. A method of controlling the octane requirement increase of spark ignition internal combustion engines which comprises operating said engines on a fuel containing a major portion of a liquid hydrocarbon base fuel boiling in the boiling range of gasoline and from about 0.001 to about 0.075 weight percent of a quaternary ammonium hydroxide selected from tetrabutylammonium hydroxide, tricaprylicmethyl ammonium hydroxide, and mixtures thereof.

2. The method of claim 1 wherein from about 0.003 to about 0.03 weight percent of said quaternary ammonium hydroxide is present.

3. The method of claim 2 wherein from about 0.005 to about 0.015 weight percent of said quaternary ammonium hydroxide is present.

4. The method of claim 1 wherein said quaternary ammonium hydroxide comprises tetrabutyl ammonium hydroxide.

5. The method of claim 1 wherein said quaternary ammonium hydroxide comprises tricaprylicmethyl ammonium hydroxide.

6. An improved gasoline composition comprising a mixture of a hydrocarbon base fuel boiling in the boiling range of gasoline and from about 0.001 to about 0.075 weight percent of a quaternary ammonium hydroxide selected from tetrabutylammonium hydroxide, tricaprylicmethyl ammonium hydroxide, and mixtures thereof.

7. The composition of claim 6 wherein from about 0.003 to about 0.03 weight percent of said quaternary ammonium hydroxide is present.

8. The composition of claim 7 wherein from about 0.005 to about 0.015 weight percent of said quaternary ammonium hydroxide is present.

9. The composition of claim 6 wherein said quaternary ammonium hydroxide comprises tetrabutyl ammonium hydroxide.

10. The composition of claim 6 wherein said quaternary ammonium hydroxide comprises tricaprylicmethyl ammonium hydroxide.

11. A gasoline additive concentrate suitable for use in a hydrocarbon base fuel boiling in the boiling range of gasoline comprising organic solvent boiling in the range of gasoline selected from the group of aromatic hydrocarbon solvents, aliphatic alcohols and mixtures thereof and a quaternary ammonium hydroxide selected from tetrabutylammonium hydroxide, tricaprylicmethyl ammonium hydroxide, and mixtures thereof said solvent being present in amounts ranging from about 20 to about 80 percent by weight of the concentrates.

12. The concentrate of claim 11 wherein said quaternary ammonium hydroxide comprises tetrabutyl ammonium hydroxide.

13. The concentrate of claim 11 wherein said quaternary ammonium hydroxide comprises tricaprylicmethyl ammonium hydroxide.

* * * * *